US006395155B1

(12) United States Patent
Bressel et al.

(10) Patent No.: US 6,395,155 B1
(45) Date of Patent: May 28, 2002

(54) ELECTROLYSIS PLATE

(75) Inventors: Bernd Bressel; Hans-Joachim Kramann, both of Dormagen (DE)

(73) Assignee: Bayer Aktiengesellschaft, Leverkusen (DE)

( * ) Notice: Subject to any disclaimer, the term of this patent is extended or adjusted under 35 U.S.C. 154(b) by 0 days.

(21) Appl. No.: 09/714,718

(22) Filed: Nov. 16, 2000

(30) Foreign Application Priority Data

Nov. 25, 1999 (DE) ..... 199 56 787

(51) Int. Cl.[7] ..... C25B 9/00

(52) U.S. Cl. ..... 204/255; 204/254; 204/268; 204/269; 204/279; 204/286.1; 204/288.1; 204/294

(58) Field of Search ..... 205/616, 620; 204/286.1, 288.1, 254, 255, 268, 269, 279, 294

(56) References Cited

U.S. PATENT DOCUMENTS 3,915,836 A * 10/1975 Born et al. ..... 204/286
4,045,325 A * 8/1977 Schwickart et al. ..... 204/286
4,233,146 A 11/1980 Rothmayer et al. ..... 204/255
4,236,983 A * 12/1980 Minz et al. ..... 204/256
4,299,681 A * 11/1981 Mose et al. ..... 204/255
4,402,811 A 9/1983 Klotz et al. ..... 204/256
6,039,852 A * 3/2000 Federico ..... 204/255
6,066,248 A * 5/2000 Lyke et al. ..... 205/637

FOREIGN PATENT DOCUMENTS

EP 266 948 5/1988

* cited by examiner

*Primary Examiner*—Bruce F. Bell
(74) *Attorney, Agent, or Firm*—Joseph C. Gil; Richard E.L. Henderson; Diderico van Eyl

(57) ABSTRACT

An electrolysis plate is described which consists of an outer non-conductive frame, particularly a frame having a fiber-reinforced cresol resin, an electrically conductive, bipolar graphite plate which is mounted therein and is preferably slotted on both sides, and, in the region of the electrolyte feed, has plastic skirts for the forced direction of the electrolyte solutions.

9 Claims, 3 Drawing Sheets

ELECTROLYSIS PLATE

FIELD OF THE INVENTION

The invention relates to an electrolysis plate having an outer non-conductive frame, in particular made of a fiber-reinforcecd cresol resin, an electrically conductive, bipolar graphite plate which is mounted therein and is preferably slotted on both sides and, in the region of the electrolyte feed, has plastic skirts, dimensioned to force the direction of electrolyte solutions, located in the region of the electrolyte feed. The invention further relates to electrolysers made with such electrolysis plates.

BACKGROUND OF THE INVENTION

Known electrolysers such as hydrochloric acid electrolysers, have electrolysis plates in the form of frame elements which carry electrically conductive, bipolar graphite plates which function as anode/cathode. Such constructions are disclosed by the publication DT 23 27 883. The frame elements are generally arranged in blocks of typically 32 or 38 plates and thus form a unit as an electrolyser having 31 or 37 electrolysis cells for the electrolysis of, for example, hydrochloric acid to give chlorine gas and hydrogen gas, which are operated at current intensities of up to 4800 A/m$^2$. The hydrochloric acid is passed through the frames, starting from conduits in the lower region of the frame elements via specially arranged boreholes, in each case on the anolyte side or the catholyte side, in each case from the bottom into the anolyte space or catholyte space respectively, and removed again in the upper region of the frame elements together with the gases generated via exit boreholes into upper conduits of the frame elements.

Known electrolysis elements are supplied, depending on the current intensity, with 130 l/h to 180 l/h of anolyte acid and catholyte acid. The hydrochloric acid at 60–80° C. meets the diaphragm separating the anolyte space from the catholyte space and is randomly distributed, after deflection, for example, at the diaphragm over the slots in the graphite or at the channel between frame and graphite plate.

In the case of the known construction of the electrolysis elements, operating faults occur owing to the loading and possibly destruction of the diaphragm, in particular, in the area of the electrolyte ingress into the anolyte space or catholyte space.

The object of the invention is to provide an electrolysis element which avoids the disadvantages of the known construction and has a comparatively longer service life.

The object is achieved of the invention by protecting the anolyte side and catholyte side of an electrolysis element with a plastic skirt. The plastic skirt is generally an inert film, particularly, a film made of polyvinyl difluoride or a polyfluorocarbon to protect the diaphragm or the membrane from chemical, thermal and mechanical corrosion due to the anolyte jet and catholyte jet incident from the boreholes present in the electrolysis element.

SUMMARY OF THE INVENTION

The invention relates to an electrolysis plate comprising (a) an outer non-conductive frame; (b) an electrically conductive, bipolar graphite plate that has an electrolyte feed and that is mounted to the non-conductive frame and (c) plastic skirts that are located in the region of the electrolyte feed and that are dimensioned to force the direction of electrolyte solutions. The invention is also directed to an electrolyser containing such electrolysis plates.

DESCRIPTION OF THE FIGURES

These and other features, aspects, and advantages of the present invention will become better understood with reference to the following description and appended claims, where

DESCRIPTION OF THE INVENTION

Figure 1:
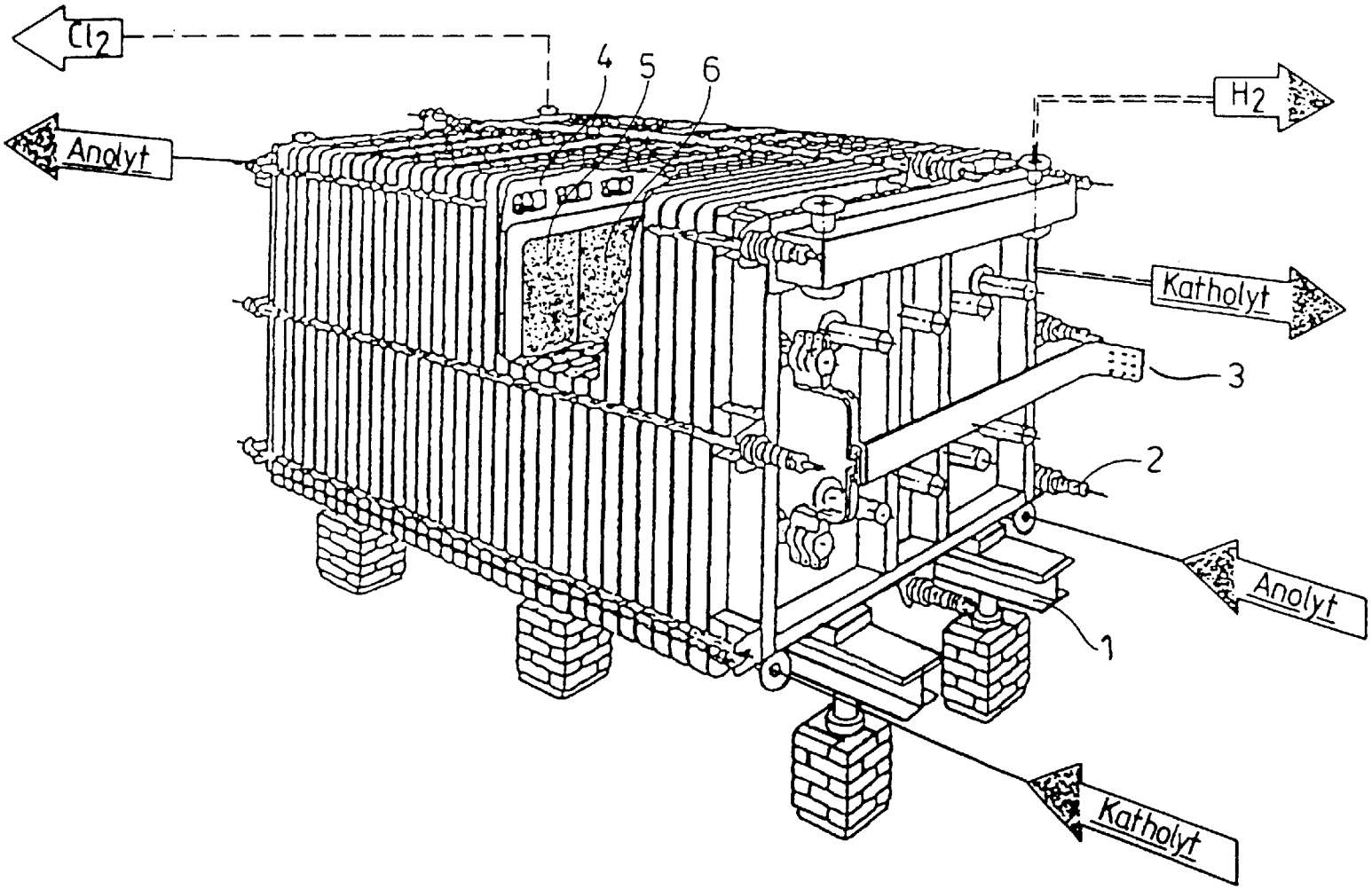
FIG. 1 shows the diagrammatic side view of an electrolyser for hydrochloric acid electrolysis.

The invention relates to an electrolysis plate having an outer non-conductive frame, particularly a frame having a fiber-reinforced cresol resin, an electrically conductive, bipolar graphite plate which is mounted therein and is preferably slotted on both sides and, in the region of the electrolyte feed, has plastic skirts for the forced direction of the electrolyte solutions. The invention further relates to electrolysers constructed on the basis of the said electrolysis plate. Preferably, the electrolysis plate with plastic skirts is used in the hydrochloric acid electrolysis as forced direction of acid for the bilateral hydrochloric acid feeds.

The structure of the frame element preferably corresponds to one that is disclosed by the publication DT 23 27 883 (U.S. Pat. No. 3,915,836, which is incorporated herein in its entirety).

The electrically conductive, bipolar graphite plate is mounted to the non-conductive frame. The plate includes an anode side, a cathode side, boreholes, an electrolyte feed, and plastic skirts. Generally, the plate has dimensions of known plates and can vary, depending on the desired application.

The plastic skirts are plastic structures such as films that are generally located in the region of the electrolyte feed and are dimensioned to force the direction of electrolyte solutions in such a way that when the plate is used in an electrolyser, the skirts protect a diaphragm or a membrane from chemical, thermal and mechanical corrosion that anolyte and catholyte jets generally cause in electrolysers that utilize ordinary electrically conductive, bipolar graphite plates. Additionally the penetration of anolyte acid respectively catholyte acid through the diaphragm is drastically reduced resulting in significantly higher product quality, e.g. significantly lower hydrogen content in chlorine or chlorine in hydrogen, when used in hydrochloric acid electrolysis. The dimensions of the skirts can vary, depending on the dimensions of the electroconductive, bipolar graphite plate.

The construction of the electrolyte feed with the plastic skirts, particularly in the forced direction of acid, is so effective that it reliably prevents direct impingement of the acid onto the damage sites observed after approximately 20–100 months of use, for example, on the diaphragms. Preferably, corner pieces in triangular shape are installed in the electrolysis plate in front of the acid inlet boreholes.

However, an improvement in a particularly preferred design of the invention is achieved by additional installation of horizontally and perpendicularly continuous perforated strips in front of inlet boreholes and in the channel between electrolysis frame and graphite plate. The films installed arc preferably fabricated from polytetrafluoroethylene (PTFE) or polyvinylidene fluoride (PVDF).

The inventive installation of the forced direction of acid surprisingly showed additionally a significant voltage decrease of 3%–8% per electrolyser with increasing system load compared with electrolysers without forced direction of acid and significantly increases the economic efficiency of the hydrochloric acid electrolysis.

The diaphragm preferably consists of, for example, tightly woven, thermally stabilized polyvinylchloride or polyvinyldifluoride or a mixed fabric of PVC and PVDF or it is in particular a membrane made of a sulphonated fluorocarbon, The invention is described in more detail below with reference to the figures by the examples which, however, do not represent any restriction of the invention.

EXAMPLES

Example 1

A hydrochloric acid electrolyser had the structure shown in side view in principle in FIG. 1. The electrolyser is shown here in dissected view in the middle.

The electrolyser was assembled on a support framework 1 having 32 electrolysis plates 4 pressed together by clamping bolts 2. The electrolysis plates 4 had at the bottom, on the right and left respectively, conduits 9 for the catholyte acid and conduits 10 for the anolyte acid which passed through the electrolyser and were supplied with fresh acid. In the central region of the electrolyser current rails 3 were provided which made electrical contact between the connections for the graphite anodes and graphite cathodes and a power supply which is not shown.

Figure 2:
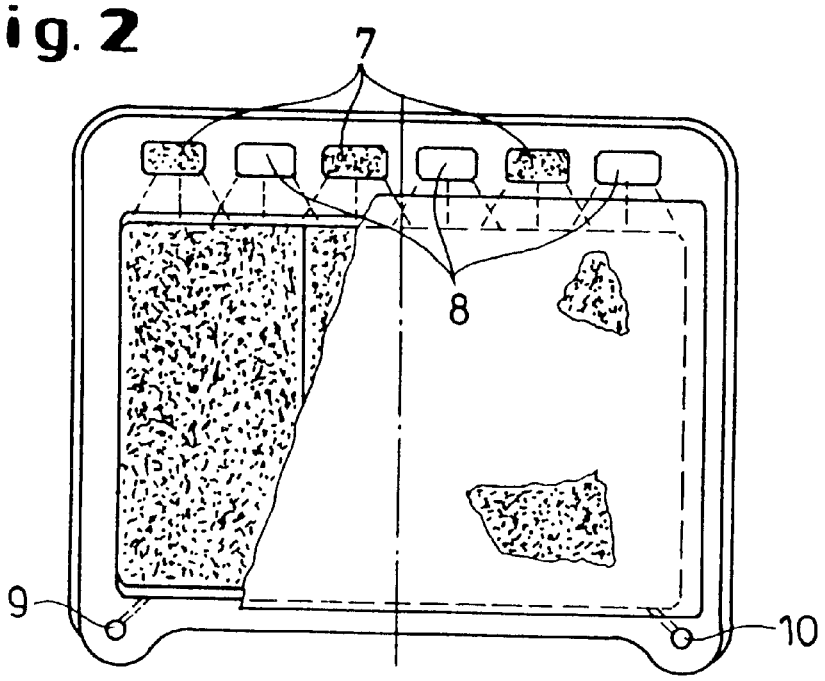
FIG. 2 shows the basic construction of an electrolysis plate in side view.

FIG. 2 shows the basic structure of an electrolysis plate 4. Boreholes 11 joined the conduits 9 for the catholyte acid to the respective catholyte space and boreholes 12 join the conduits 10 for the anolyte acid to the corresponding anolyte space. The hydrochloric acid passed upwards through the cathode space or anode space and exited again together with the electrolysis gases in the catholyte space in the upper region of the electrolysis plate 4 via boreholes 13 to the conduits 8 and in the anolyte space via boreholes 14 to the conduits 7.

Figure 3:
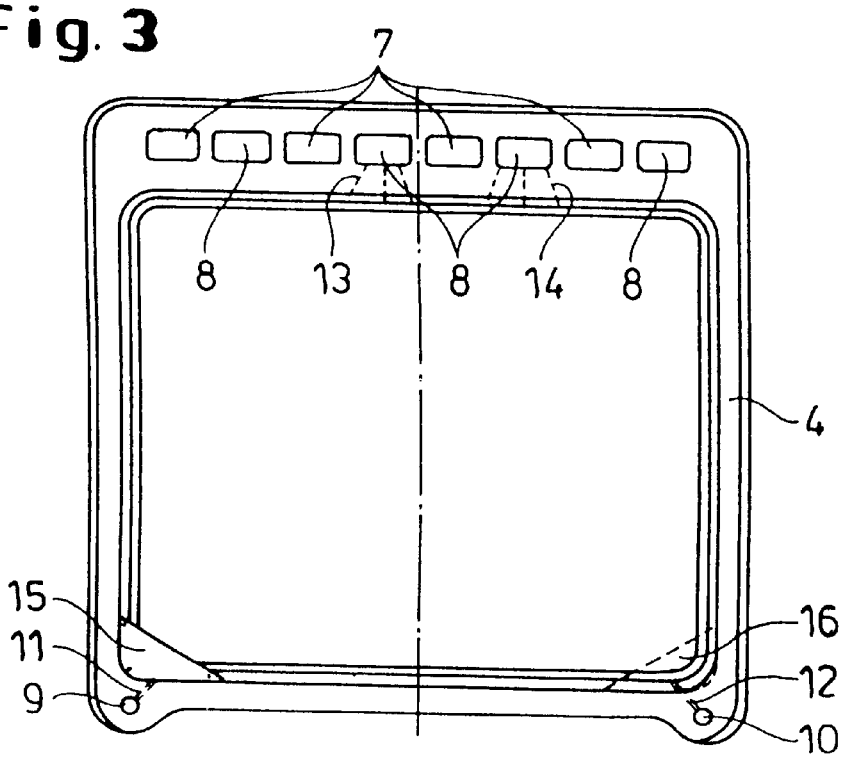
FIG. 3 shows the diagrammatic side view of an electrolysis plate according to the invention.

In the electrolysis plate 4 design shown in FIG. 3, in the region of the boreholes 11 and 12, plastic skirts (inlet-side films 15 and 16) were applied which protect the diaphragm 6. The films had a thickness of 0.5 mm and were fixed in the form of scalene triangles having the dimensions 190×290 mm with rounded corners and smooth cut edges to the diaphragm 6 or to the membrane in the corners in front of the acid inlet openings in special boreholes in the frame by rounded acid-resistant plastic rivets (not shown). One plastic skirt (film triangle 15 and 16) each was provided here in front of the anolyte inlet and catholyte inlet (FIG. 3).

The gases produced at the anode and cathode ensured adequate mixing and supply of the anode and cathode with hydrochloric acid.

Example 2

Figure 4:
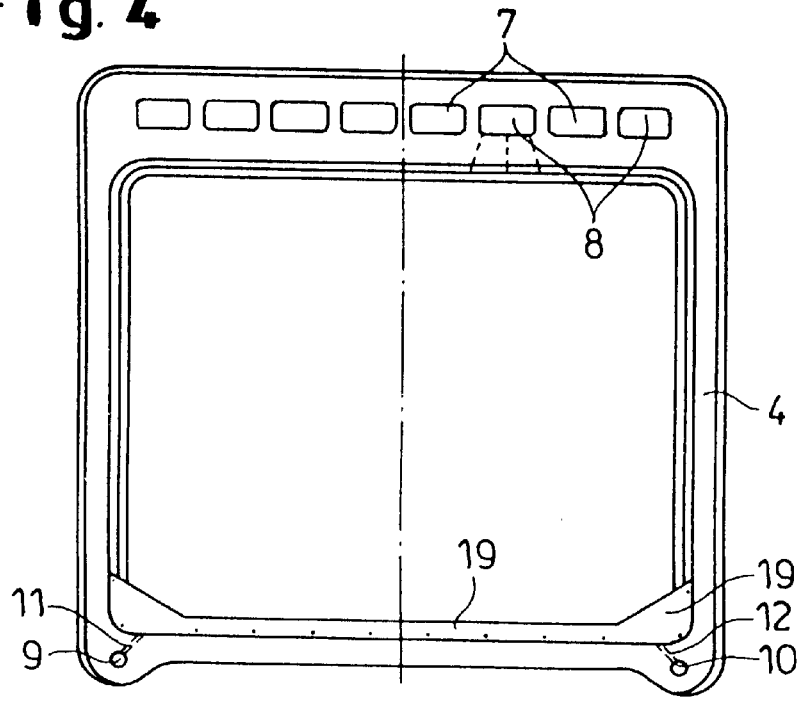
FIG. 4 shows the diagrammatic side view of a variant of the electrolysis plate according to FIG. 3.

FIG. 4 shows the diagrammatic side view of a variant of the electrolysis plate according to Example 1 having horizontally continuous skirts.

The built-in entire skirts, which especially also served for mechanical protection of membranes, were fabricated from a PTFE or PVDF strip of length 1760 mm and width 190 mm. Over its length, the film had a width of 60 mm, but the two corners end in scalene triangles which begin 220 mm from the end and have an outer edge length of 190 mm. All edges were rounded and deflashed. The attachment was made as described in Example 1 using plastic rivets in the electrolysis frame 4 on the anolyte side and catholyte side (FIG. 4).

Example 3

Figure 5:
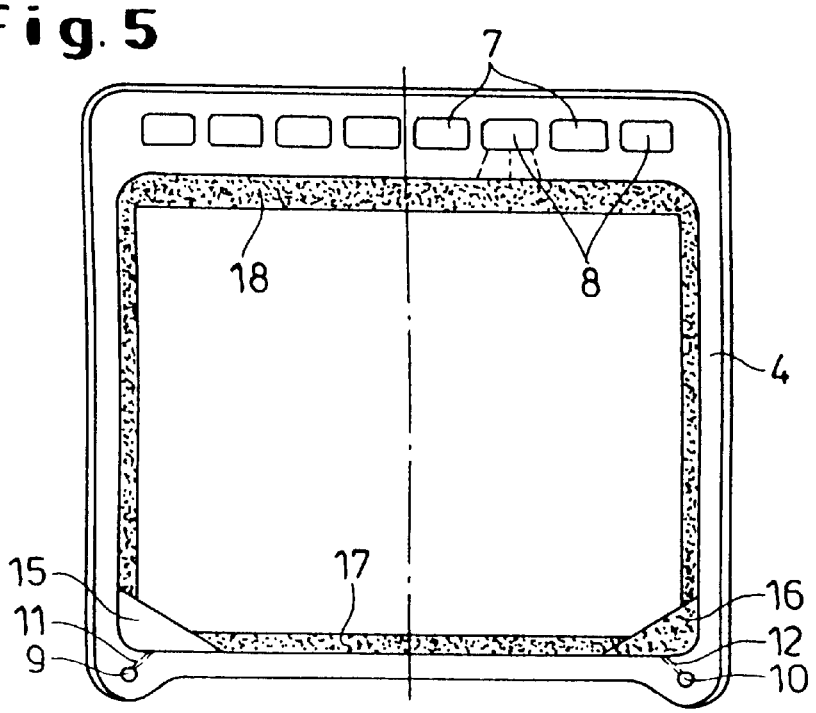
FIG. 5 shows the diagrammatic side view of another variant of the electrolysis plate according to FIG. 3.

FIG. 5 shows the diagrammatic side view of a further variant of the electrolysis plate according to Example 1 equipped with triangular skirts and horizontally and perpendicularly continuous perforated films in the edge region of the electrolysis plate 4.

For the protection of diaphragm 6 or membrane, one perforated side film 17 of thickness 0.25 mm and width 40 mm was fixed on each of the two sides of the frame 4, in which case the graphite is to be overlapped by the perforated film by at least 10 mm. The upper film 18 was made of 100 mm high perforated film, 0.25 mm thick, and the lower film was approximately 60 mm high. The triangular plastic skirts 15 E and 16 which were fixed facing away from the inlet boreholes 11 and 12 for anolyte acid and catholyte acid were also fabricated from perforated film. The film was cut in such a manner that no holes were cut through. The perforated film cover was applied here both on the anode and on the cathode. (FIG. 5)

Although the invention has been described in detail in the foregoing for the purpose of illustration, it is to be understood that such detail is solely for that purpose and that variations can be made there in by those skilled in the art without departing from the spirit and scope of the invention except as it may be limited by the claims.

What is claimed is:

1. An electrolysis plate comprising:

(a) an outer non-conductive frame;

(b) an electrically conductive, bipolar graphite plate having an electrolyte feed, said plate being mounted to the non-conductive frame; and (c) plastic skirts, located in the region of the electrolyte feed, and dimensioned to force the direction of electrolyte solutions.

2. The electrolysis plate of claim 1, wherein the graphite plate is slotted on both sides.

3. The electrolysis plate of claim 1, wherein the outer non-conductive frame has a fiber-reinforced cresol resin.

4. The electrolysis plate according to claim 1, wherein the electrolysis plate is formed with plastic skirts which serve in the hydrochloric acid electrolysis as forced direction of acid for the bilateral hydrochloric acid feeds.

5. The electrolysis plate according to claim 1, wherein the plastic skirts comprise polytetrafluoroethylene or polyvinylidene fluoride.

6. The electrolysis plate according to claim 5, wherein the planar shape of the individual plastic skirts is triangular.

7. The electrolysis plate according to claim 1, wherein continuous perforated strips arranged horizontally and perpendicularly in the edge region of the frame, are additionally arranged in front of inlet boreholes and in the channel between electrolysis frame and graphite plate.

8. The electrolysis plate according to claim 1, wherein the plastic skirts are formed continuously horizontally in the lower region of the electrolysis plate.

9. An electrolyser constructed on the basis of at least one electrolysis plate according to claim 1.

* * * * *